United States Patent [19]

Willemse et al.

[11] Patent Number: 4,475,827

[45] Date of Patent: Oct. 9, 1984

[54] TEXT PROCESSING DEVICE COMPRISING AN EXCHANGEABLE DISC HAVING FLEXIBLE SYMBOL ARMS

[75] Inventors: Theodorus J. M. Willemse, Berlicum; Martinus T. Vorstenbosch, Den Dungen, both of Netherlands

[73] Assignee: Business Systems Incorporated B.V., Den Bosch, Netherlands

[21] Appl. No.: 351,584

[22] Filed: Feb. 23, 1982

[30] Foreign Application Priority Data

Dec. 21, 1981 [NL] Netherlands ..... 8105753

[51] Int. Cl.[3] ..... B41J 1/30

[52] U.S. Cl. ..... 400/144.2; 400/171; 400/175

[58] Field of Search ..... 400/144.2, 144.3, 175, 400/171, 149–151.1

[56] References Cited

U.S. PATENT DOCUMENTS

| | | | |
|---|---|---|---|
| 4,202,639 | 5/1980 | Rello | 400/144.2 X |
| 4,245,916 | 1/1981 | Habich et al. | 400/144.2 |
| 4,310,255 | 1/1982 | Asano et al. | 400/175 X |
| 4,314,770 | 2/1982 | Harre | 400/144.2 X |
| 4,332,490 | 6/1982 | Tschudi | 400/144.2 X |

FOREIGN PATENT DOCUMENTS

| | | | |
|---|---|---|---|
| 44659 | 4/1981 | Japan | 400/144.2 |
| 7808762 | 2/1980 | Netherlands | 400/144.2 |

*Primary Examiner*—Paul T. Sewell

*Attorney, Agent, or Firm*—Diller, Ramik & Wight

[57] ABSTRACT

A text processing device, for example a typewriter, comprising a first guide for text receiving sheet material, a carrier slidable along a second guide for a disc being rotatable about an axis and having flexible, radial symbol arms and a hammer mechanism mounted fixedly on the carrier opposite the first guide touching each symbol arm, wherein the disc has a central orifice for receiving a pin journalled in the carrier and being displaceable with the aid of a mechanism from a retracted position to a projecting operational position and conversely, in which projecting position the pin snaps into said orifice, whereas the disc is equipped with a registering member disposed near said central orifice and cooperating with a driving element setting the angular position of the disc, said driving element being journalled coaxially with the pin in the carrier.

5 Claims, 10 Drawing Figures

FIG.10
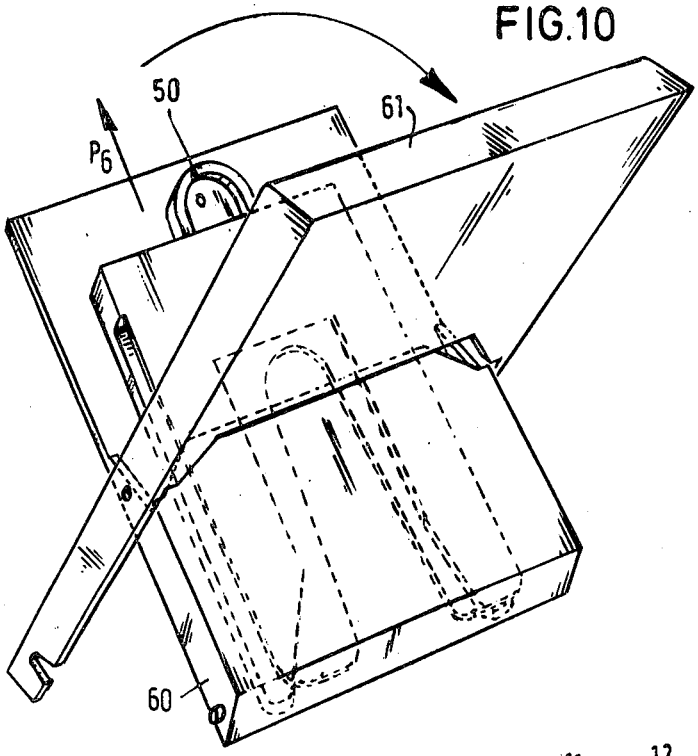
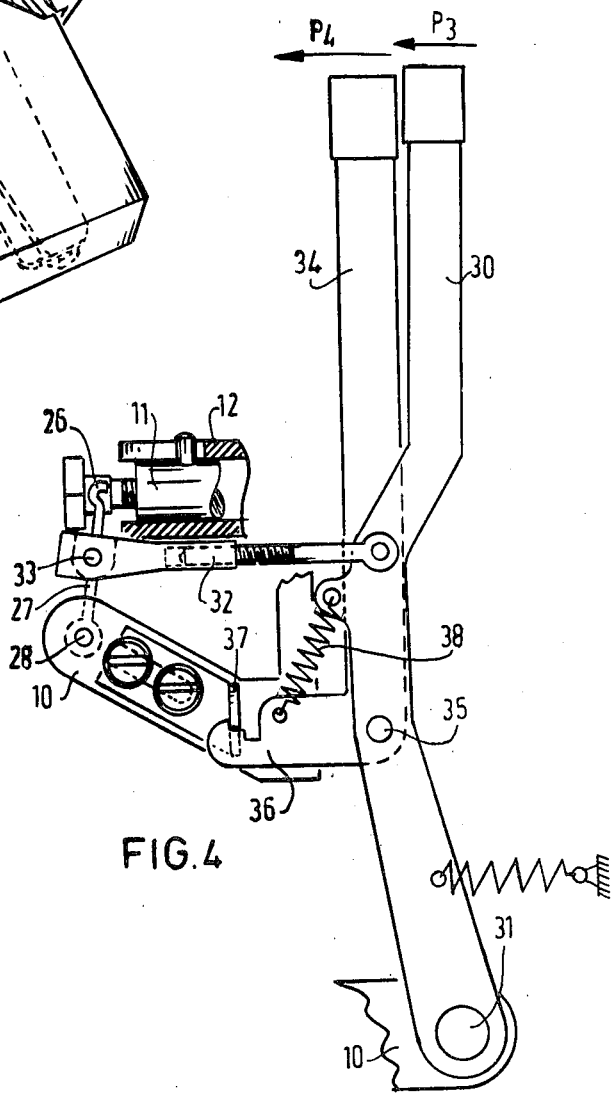
FIG.4

FIG. 8
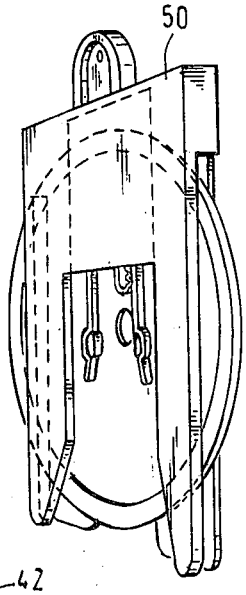
FIG.9
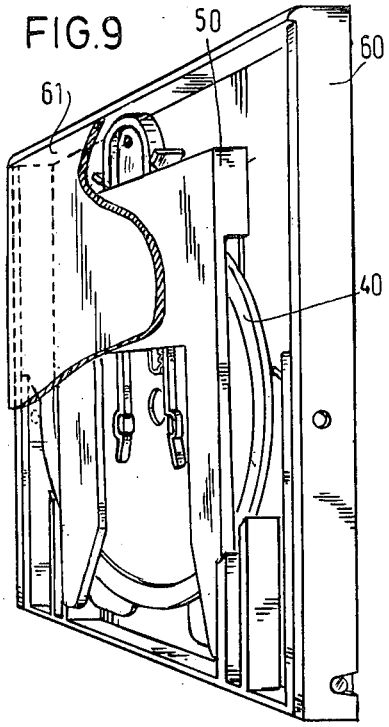
FIG.5
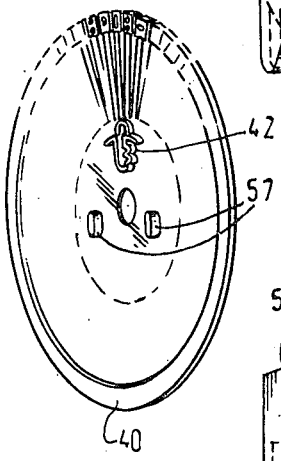
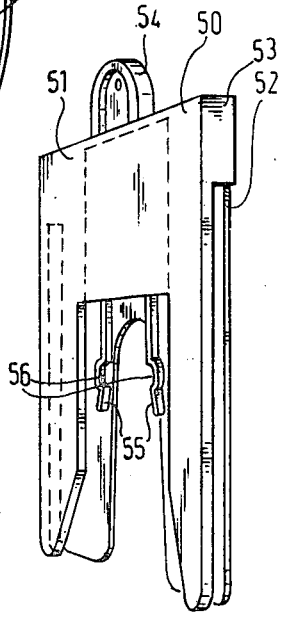
FIG. 6
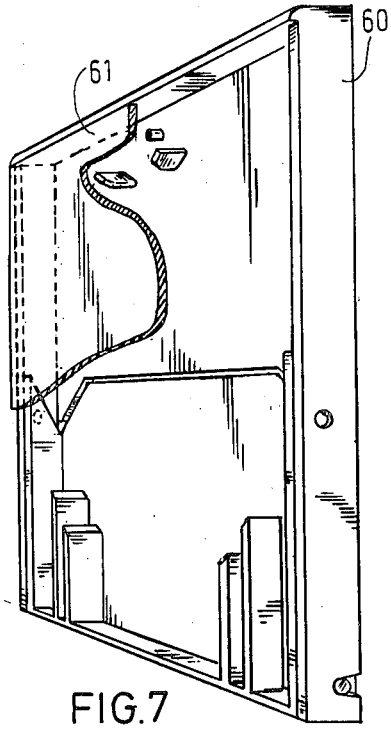
FIG.7

TEXT PROCESSING DEVICE COMPRISING AN EXCHANGEABLE DISC HAVING FLEXIBLE SYMBOL ARMS

This invention relates to a text processing device, for example, a typewriter, comprising a first guide for text receiving sheet material, a carrier slidable along a second guide for a disc being rotatable about an axis and having flexible, radial symbol arms and a hammer mechanism mounted fixedly on the carrier opposite the first guide touching each symbol arm.

The invention has for its object to improve a text processing device of the kind set forth in the preamble in a sense such that the exchange of the disc with the symbol arms, also termed "daisy", is facilitated and, in addition the construction of the carrier is simplified, which will lower its cost.

The device according to the invention is distinguished in that the disc has a central orifice for receiving a pin journalled in the carrier and being displaceable with the aid of a mechanism from a retracted position to a projecting operational position and conversely, in which projecting position the pin snaps into said orifice.

Owing to the use of the retractable pin the disc can be readily put in place without additional manipulations such as tilting of the carrier and the removal of the hammer mechanism respectively, as is common practice in the known machines.

Near the end of the pin there is preferably provided a pressing member, whilst the carrier has a counter-bearing coaxial with the pin. Consequently, the disc can be fixed by pressure in the working position simultaneously with the displacement of the pin.

In order to locate the disc in the correct angular position in the machine, it is equipped with a registering member disposed, in accordance with the invention, near the central orifice and co-operating with a driving element setting the angular position of the disc, which is journalled coaxially with the pin in the carrier. In this way a very compact construction of the carrier is obtained, whilst a reliable operation and precise script are maintained.

It is common practice to arrange such a disc of characters in the machine by means of auxiliary tools, the disc being clamped in an auxiliary tool and subsequently arranged in the machine with said auxiliary tool. According to the invention this auxiliary tool is provided with at least one resilient tongue co-operating with a guard lug on the side of the registering member of the disc. This tongue not only has a clamping effect, but also serves to ensure that the disc is accommodated in the correct position in the mounting tool so that during mounting the registering member is in the correct position with respect to the driving element. Owing to the fact that the tool engages the side of the disc, the disc can be provided throughout its circumference with flexible, symbol-carrying arms so that the amount of available characters can be increased.

Preferably the resilient tongue extends at least into proximity of the central orifice of the disc in order to permit the pressing member in its working position of obviating the blocking effect of the resilient tongue, i.e., to release the disc.

According to the invention the mounting expedient is, moreover, provided with a guide in order to permit of arranging it in a different holder. This different holder may be a separate cassette, for example, for sale purposes, but also a holder in the machine housing of the text processing device.

The invention will now be described more fully with reference to an embodiment.

FIG. 4 is a schematic side elevation of the control-mechanism for the mounting pin.

FIG. 5 is a perspective elevational view of a character disc provided with locking and registering means.

FIGS. 6, 7, 8, 9, and 10 are perspective views of the mounting tool and holder respectively for accommodating said mounting tool.

Figure 1:
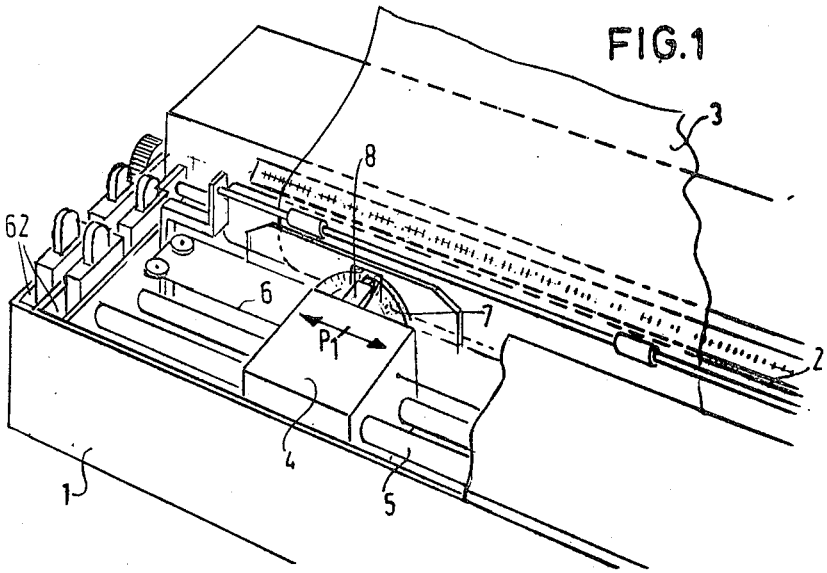
FIG. 1 is a perspective plan view of a text processing device.

The text processing device shown in FIG. 1 comprises, in general, a machine housing 1 having a first guide 2 for a text receiving sheet 3. This first guide 2 is illustrated herein in the form of a conventional plate and sheet guiding members and does not lie within the scope of the present invention and is supposed to be known.

In front of the first guide 2 a carrier 4 is reciprocatorily slidable along a second guide 5 in the direction of the arrow P1 by means of a driving and cable system 6 (not shown). The carrier serves for displacing to and fro a character disc or daisy wheel 7 and a hammer mechanism 8 co-operating herewith.

Figure 3:
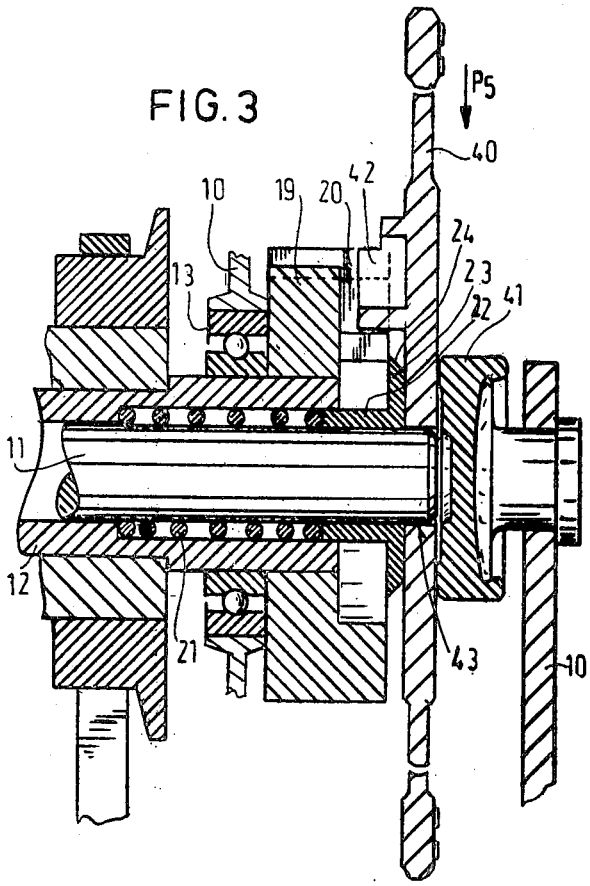
FIG. 3 is a cross-sectional view of part of the carrier near the end of the mounting pin and the counter-bearing.
Figure 2:
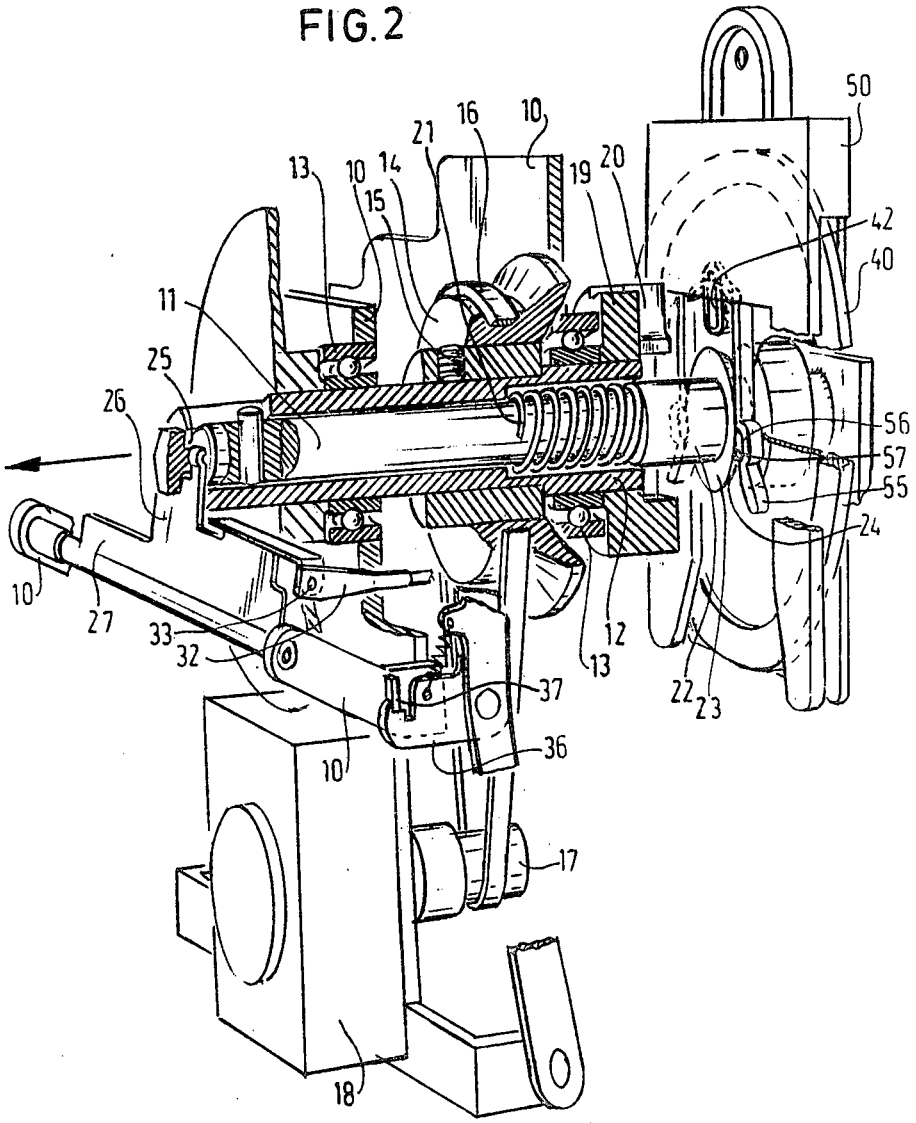
FIG. 2 is a perspective front view of the carrier provided with the exchanging mechanism for the character disc embodying the invention.

The carrier is shown, in principle, in FIGS. 2 and 3. The frame of the carrier 10 may be shaped in any appropriate shape and holds a pin 11 arranged coaxially in a sleeve 12 journalled in the frame 10. By means of bearings 13 the sleeve is freely rotatable in the frame plates 10. The sleeve 12 has fastened around it a driving wheel 14 by means of a set screw 15. The driving wheel 14 is surrounded by a toothed belt 16, which passes to a smaller driving wheel 17 fastened to the output shaft of a motor 18. The motor 18 is controlled by the machine logic and may be formed by a step motor suitable to set the wheel 14 in such an angular position that the desired flexible symbol arm of the disc is in the correct angular position, which will be explained further hereinafter.

At the front the sleeve 12 is provided with a disc-shaped element 19 having an upwardly opening or radially extending niche or recess 20 which receives the registering and catching member or lug 42 of the disc.

The pin 11 is axially displaceable in the sleeve 12 and is urged to the right as viewed in FIG. 2 by means of a compression spring located in a widened bore of the sleeve 12. The compression spring bears on a hub or pressing member 22 rigidly secured to the end of the pin 11 and having at the right-hand end a flange or plate 23 having a bevelled side 24 (see FIG. 3). The hub and the flange are disposed so that the pin 11 still extends further to the right.

The rear end of the pin 11 has a circumferential groove 25 receiving a fork 26 of a swash plate 27 journalled in the frame 10. The plate 27 is pivotable about a shaft 28 by means of a manually operable setting mechanism shown in FIG. 4. The setting mechanism comprises a lever 30, having a fulcrum 31 in the frame 10. Midway the lever is pivotally connected to a pushing rod 32 leading to a pivotal point 33 of the swash plate 27. When the lever 30 moves in the direction of the arrow P3 about the fulcrum 31 the pushing rod 32 moves in the same direction and the swash plate 27 will tilt in anti-clockwise direction and thus move the shaft 11 via the fork 26 to the left as viewed in FIGS. 2 and 3.

Simultaneously with the left-hand movement a second lever 34, which is rotatably connected at 35 with the first lever 30, will fall by its hook-like lower end 36 behind a lug 37, which is rigidly secured to the frame 10. A recess in the arm 36 will get around the lug 37 by means of a tensile spring 38 between the levers 30 and 34. The locking mechanism ensures that the pin 11 remains in the retracted position against the action of the spring 21.

In order to disengage the locking mechanism the user need only move the lever 34 in the direction of the arrow P4 so that the lower end 36 will turn in anti-clockwise direction around point 35 and the recess moves away from the lug 37. The lever 30 will thus directly move to the right, as viewed in FIG. 4 as a result of the counter-acting spring 21.

The setting mechanism described above serves to facilitate the disposition of the disc 40 (see FIGS. 2 and 3). It will be obvious that by a left-hand movement of the pin 11 (FIG. 3) the space between the right-hand head face of the driving element 19 and the counter-bearing 41 turning in the frame 10 is released so that the disc 40 can be inserted in the direction of the arrow P5 until the registering member 42 arranged on the disc 40 falls into the open niche 20 of the driving member 19. When the pin 11 is moved to the right, it will extend through the central orifice 43 of the disc, whilst the right-hand head face of the disc 23 pressed against the left-hand side of the disc 40 and simultaneously clamps tight on the counter-bearing or rotatable plate 41. Thus the character disc is mounted and ready for use.

It will be noted that the first means, comprising the rotatable plate 41, the spring biassed pin 11 with its plate 23 and end portion which projects into the central opening of the daisy wheel, effects centering of the daisy wheel and clamps it in the proper plane whereas the second means, comprising the laterally projecting lug 42 received in the radially extending recess 20 of the coupling member 19, effects the drive coupling for the daisy.

It will be seen that said second means mechanically couples the drive means to the daisy wheel in response to insertion of the daisy wheel into operative relation to the first means. That is to say, when the firat means is withdrawn away from clamping position, a daisy wheel may be registered therewith by inserting the lug 42 into the recess 20.

Since the character disc 40 provided with the flexible character arms is rather sensitive to deformation, it is preferred to arrange the disc by means of an auxiliary mounting tool 50.

This mounting tool is shown in FIGS. 6 and 8 and mainly comprises a front and rear face 51 and 52 respectively gripping around the disc 40. At the sides said faces are interconnected by partitions 53 and they are equipped with a handle 54. The face 51 is incised from below and in the incision two resilient tongues 55 extend downwards. The resilient tongues have recesses 56 snapping around lugs 57 of the disc 40. These lugs 57 are disposed relatively to the central orifice in the disc in a manner such that when the disc 40 is placed in the tool 50, the registering member 42 will invariably extend upwards. The auxiliary tool 50 can be lowered by means of the handle 54 from above into the machine and the registering member 42 will automatically snap into the open niche of the driving member 19. When the pin 11 is released, it is furthermore ensured that the bevelled side 24 of the flange 23 urges the resilient tongues 55 away from one another so that the latter are released from the lugs 57 on the disc 40 (see FIG. 2). Therefore, as soon as the pin 11 is in the central orifice of the disc, the auxiliary tool 50 can be taken out of the machine without being hindered.

FIGS. 7, 9, and 10 show a holder or cassette 60 for accommodating the auxiliary tool 50 with the character disc 40. This holder comprises a closed casing 60 with a pivotable cover 61 so that the tool 50 can be taken out of the holder in the direction of the arrow P6. (see FIG. 10).

The tool 50 together with the character disc can, moreover, be arranged in a storing space 62, which may form part of the machine housing 1.

From the foregoing description it will be obvious that a text-processing device 1 can be provided in a simple manner with different character discs, which are stored in the space of the machine housing. The exchange of the character disc only requires taking out the set of mounting tools with the character disc, withdrawing lever 30, disposing the mounting tool 50, withdrawing lever 34 and taking out the mounting tool 50. For taking out the mounting tool 50 need only be arranged over the character disc and the lever 30 need be withdrawn, after which the set of mounting tool and character disc can be taken out of the machine. Additional manipulations such as removal of the hammer mechanism, of the ribbon mechanism, tilting of the carrier and so on are thus avoided.

What is claimed is:

1. A text processing device comprising a first guide for text receiving sheet material, a carrier displaceable along a second guide and carrying a disc rotatable about an axis and having flexible, radial symbol arms and a hammer mechanism rigidly mounted on the carrier opposite said first guide for touching each symbol arm characterized in that the disc has a central orifice receiving a pin journalled in the carrier and being displaceable with the aid of a mechanism from a retracted position into a projecting operational position and conversely, the pin snapping into said orifice in the latter position, in that a pressing member is fastened near the end of the pin and the carrier includes a counter-bearing coaxial with the pin, the disc being provided with a registering member, the registering member being arranged near the central orifice and adapted to co-operate with a driving element setting the angular position of the disc and being journalled in the carrier independently of and coaxially with the pin.

2. A device as claimed in claim 1 and comprising a mounting tool for putting in place and taking out a disc respectively characterized in that the mounting tool is provided with a resilient tongue co-operating with at least one guard lug on the side of the registering member of the disc.

3. A device as claimed in claim 2 characterized in that the resilient tongue extends at least into proximity of the central orifice of the disc in order to disengage the resilient tongue from the lug, when the pressing member is in the working position.

4. A device as claimed in claim 3 characterized in that the auxiliary tool encloses the disc and is provided with a guide for storage in a holder.

5. In a text processing device, having a carrier, a printing hammer disposed in fixed relation to said carrier, a daisy wheel rotatably mounted on said carrier such that its periphery sweeps past said hammer, and drive means for angularly positioning said daisy wheel to dispose selected portions of its periphery sequentially opposite said hammer, the improvement wherein:

a sleeve is rotatably mounted on said carrier for positioning by said drive means, a pin slidable in said sleeve and projecting beyond one end thereof, a rotatable plate carried by said carrier for rotation about an axis concentric with said sleeve and disposed in fixed spaced relation to said sleeve beyond said one end thereof, a second plate carried by said pin adjacent the projecting end thereof in opposed relation to said rotatable plate, spring means normally biassing said pin toward said rotatable plate, said daisy wheel being clamped between said rotatable plate and said second plate and having a central locating opening receiving said projecting end of the pin, said daisy wheel also having a laterally projecting drive lug offset from the center thereof, and a drive coupling member carried by said sleeve and having a radially extending recess receiving said drive lug to angularly locate the daisy wheel relative to said sleeve and to effect angular positioning thereof.

* * * * *